United States Patent [19]

Yoshihara

[11] Patent Number: 5,002,174

[45] Date of Patent: Mar. 26, 1991

[54] COIN VALIDATOR

[75] Inventor: Kenzo Yoshihara, Konosu, Japan

[73] Assignee: Kabushiki Kaisha Nippon Conlux, Tokyo, Japan

[21] Appl. No.: 354,047

[22] Filed: May 19, 1989

[30] Foreign Application Priority Data

May 27, 1988 [JP] Japan ..... 63-129985

[51] Int. Cl.[5] ..... G07D 5/08

[52] U.S. Cl. ..... 194/317; 194/330; 194/335

[58] Field of Search ..... 194/317, 318, 330, 328, 194/335; 324/663

[56] References Cited

U.S. PATENT DOCUMENTS

| | | | |
|---|---|---|---|
| 4,184,366 | 1/1980 | Butler . | |
| 4,322,678 | 3/1982 | Capots et al. | 324/663 |
| 4,353,453 | 10/1982 | Partin et al. | 194/319 |
| 4,819,780 | 4/1989 | Trummer et al. | 194/317 |

FOREIGN PATENT DOCUMENTS

| | | |
|---|---|---|
| 1673841 | 6/1971 | Fed. Rep. of Germany . |
| 39-21291 | 9/1964 | Japan . |
| 40-21580 | 9/1965 | Japan . |
| 52-69395 | 6/1977 | Japan . |
| 53-82387 | 7/1978 | Japan . |
| 56-123090 | 9/1981 | Japan . |
| 59-131104 | 7/1984 | Japan . |
| 61-72391 | 4/1986 | Japan . |
| 61-88387 | 5/1986 | Japan . |

*Primary Examiner*—F. J. Bartuska

*Attorney, Agent, or Firm*—Diller, Ramik & Wight

[57] ABSTRACT

A coin validator of a static capacitance system for discerning the thickness and/or pattern of a coin in a non-contact manner. A pair of electrode assemblies including a first and a second sensor electrodes and a first and a second guard ring electrodes are disposed on the corresponding sides of a coin path. The first and the second guard ring electrodes prevent the dispersion of electric lines of force generated by the first and the second sensor electrodes. The first and the second sensor electrodes are impressed with resonating output signals from resonators. Under such condition, when the coin passes through the coin path between these electrodes, the entire inter-electrode capacitance changes to fluctuate the resonating output voltage and hence allow the thickness and/or pattern of the coin to be detected. The guard ring electrodes serve to focus the electric lines of force into a beam to thereby allow the thickness of the coin to be detected finely.

15 Claims, 5 Drawing Sheets

COIN VALIDATOR

BACKGROUND OF THE INVENTION

1. Field of the Invention

This invention relates to coin validators used in various automatic service devices of a vending machine or the like, and more particularly to such validators which discern the thickness and/or patterns of coins in a non-contact manner.

2. Description of the Related Art

Electronic coin validators used very often today include an oscillator coil disposed on one side of a coin path and a receiver coil disposed on the other side of the coin path and coupled electromagnetically to the oscillator coil to detect the outer shape and material of a coin during its passage to determine the validation and kind of the coin in accordance with an attenuated waveform of a voltage output by the receiver coil.

These validators are suitable for detecting the diameter and material of a coin using the oscillator and receiver coil, but are not suitable for detecting the thickness and pattern of the coins. If these validators detect the thickness and pattern of a coin, a signal containing a component depending on the material of the coin appears in the receiver coil output, so that it is necessary to provide a circuit to eliminate signal components depending on the coin material, and hence the structure of the validator would be complicated. In order to respond to a change in the thickness of its details such as a pattern, the coin must be stopped temporarily, or an extremely high speed circuit unit must be used, so that the mechanism and circuit structure would be complicated. It is impossible to discern a false coin, especially, of the same material and shape as a genuine one using such selective method.

Generally, the face of a false coin is flat while the face of a genuine coin has a rugged pattern and an uneven thickness.

A method of selecting a coin in accordance with a varying electrode capacitance due to a rugged face or appearance of the coin, namely, caused by inserting the coin between a pair of electrode plates, is disclosed, for example, in Japanese Published Examined Patent Application Sho 39-21291.

In the selective method disclosed in the Application, when a coin to be selected is inserted between the pair of electrode plates, the static capacitance present between the pair of electrode plates changes. Such pair of electrode plates are connected as one of the elements of a capacitor bridge or as one of oscillating elements of an oscillator to thereby select a coin using an unbalance in the capacitor bridge or an oscillation or non-oscillation of the oscillator.

However, since the electrode structure includes a mere arrangement of two opposing electrode plates, the electric lines of force from the electrode plates are dispersed, so that a fine change in the rugged face of the coin cannot be detected, and secure detection cannot be achieved.

It is therefore an object of the present invention to provide a coin validator which discerns the thickness and/or pattern of a coin with high reliability.

SUMMARY OF THE INVENTION

The present invention provides a coin validator comprising a first sensor electrode disposed on one side of a coin path; a first guard ring electrode provided so as to surround the first sensor electrode for preventing the dispersion of the electric lines of force generated by the first sensor electrode; a second sensor electrode disposed on the other side of the coin path so as to oppose the first sensor electrode; a second guard ring electrode provided so as to surround the second sensor electrode for preventing the dispersion of the electric lines of force generated by the second sensor electrode; an oscillator for outputting an oscillating signal of a predetermined frequency; a resonator resonating with the oscillating signal from the oscillator for applying the resonating output therefrom to the first and second sensor electrodes; and means for detecting the nature of the coin in accordance with the output voltage signal from the resonator during the passage of the coin through the coin path.

The electrodes disposed on the corresponding sides of the coin path, namely, the first and second sensor electrodes which detect a change in the inter-electrode capacitance generated during coin passage, and the first and second guard ring electrodes which prevent the dispersion of the electric lines of force generated by the first and second sensor electrodes apply across the coin path the electric lines of force due to a resonating output signal. When the coin passes between a pair of electrode assemblies, one assembly including the first sensor electrode and the first guard ring electrode, and the other assembly including the second sensor electrode and the second guard ring electrode, the static capacitance between the electrode assemblies changes to thereby change the resonating output voltage. This change follows a change in the thickness and/or pattern of the coin. Thus the thickness and/or pattern of the coin are detected by a voltage or waveform indicative of this change. If the change in the resonating output voltage signal is within a range of a predetermined reference voltage, the coin is confirmed to be within an allowable predetermined thickness condition. If an output waveform is generated which crosses a predetermined voltage level several times, the coin is considered to fluctuate within a predetermined thickness range and can be determined to "have a pattern". In this case, the electric lines of force from the sensor electrodes are focused into a beam by the guard ring electrodes, so that the thickness of the coin can be detected finely.

As just described above, according to the present invention, the arrangement is such that the thickness and/or pattern of a coin is detected using a change in the static capacitance on the pair of electrode assemblies, and the magnitude of a change of and the waveform of the resonating voltage due to the change in the static capacitance. Therefore, the thickness and/or pattern of the coin is discerned with high reliability.

DESCRIPTION OF THE PREFERRED EMBODIMENTS

Figure 1:
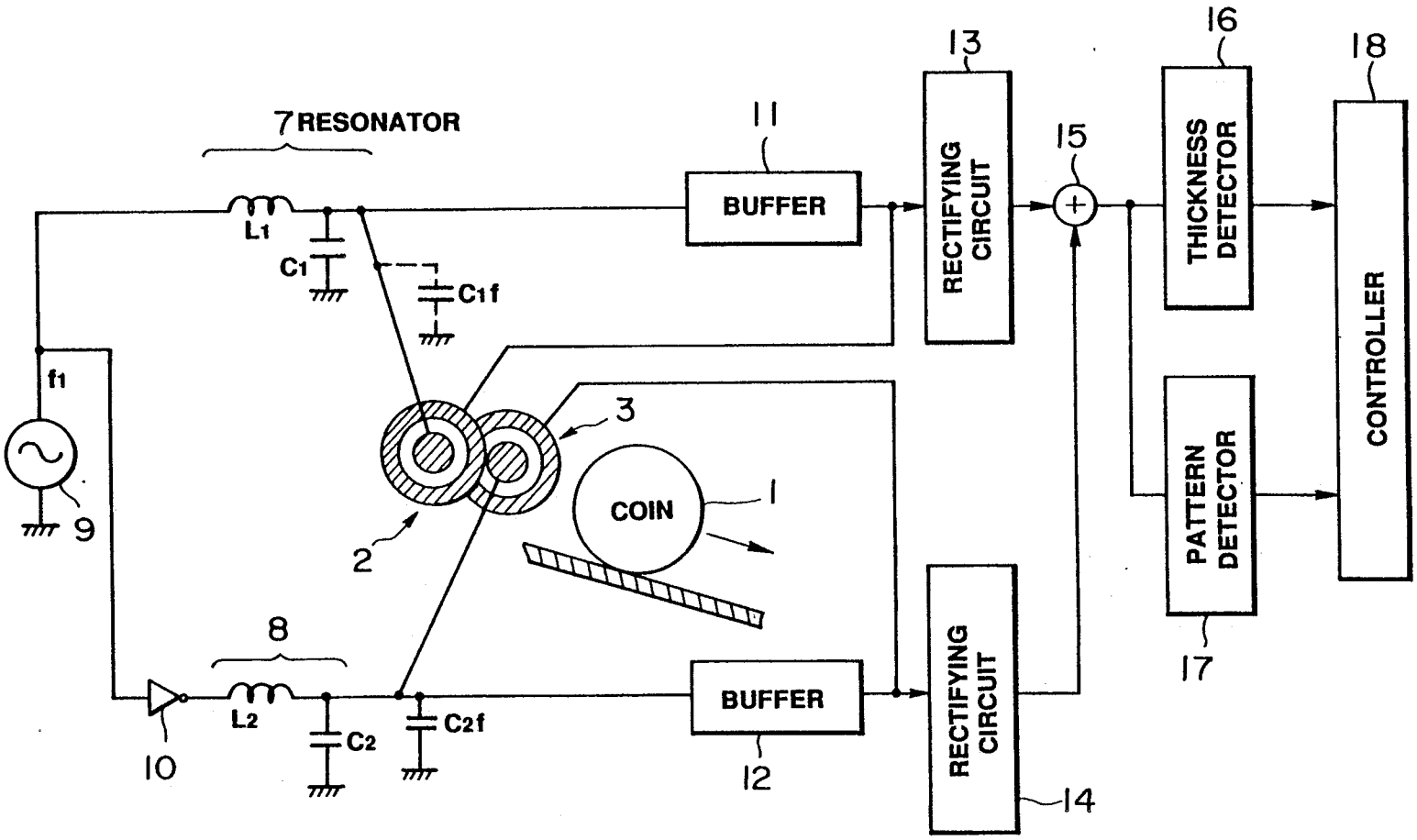
FIG. 1 is a circuit diagram of one embodiment of the present invention.

FIG. 1 is a circuit diagram of an embodiment of a coin validator according to the present invention. In FIG. 1, a pair of opposing electrode assemblies 2 and 3 are disposed on the corresponding sides of a coin path so as to face the front and back faces of a coin 1. As shown in a cross section view of the coin path in FIG. 2, these electrode assemblies 2 and 3 are constituted by sensor electrodes 4A and 4B disposed at a center, and guard ring electrodes 5A and 5B disposed so as to surround the corresponding sensor electrodes in order to prevent the dispersion of the electric lines of force 6 from the sensor electrodes 4A and 4B, respectively.

The sensor electrodes 4A and 4B are impressed with the output signals from resonators 7 and 8 which resonate with a resonating frequency f0 determined by coils L1 and L2, capacitors C1 and C2 and stray capacitances C1f and C2f including the capacitances inherent to the electrode assemblies 2 and 3, respectively. The resonator 7 receives an oscillation signal from an oscillator 9 which oscillates at a frequency f1 while the resonator 8 receives an oscillation signal comprising an inverse of the oscillation signal from the oscillator 9 and supplied via an invertor 10 and having an inverted polarity. In this case, the oscillation frequency f1 is set to a value higher than the resonating frequency f0. When the resonator resonates at f0, a voltage V1 is generated across each of the capacitor C1 and C2.

Figure 2:
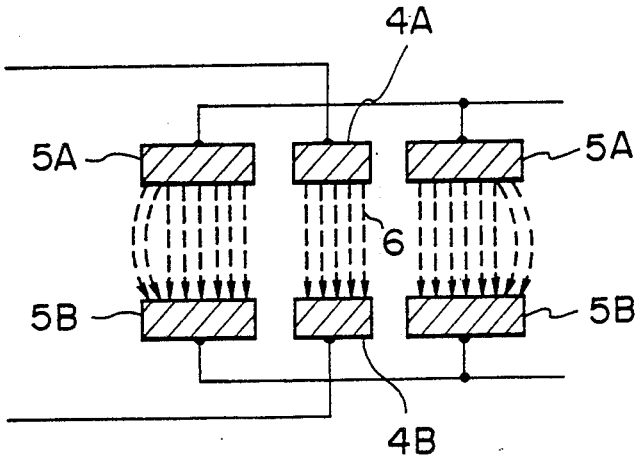
FIG. 2 illustrates the structure of a pair of opposite electrode assemblies.

The outputs of the capacitances C1 and C2 are connected to the corresponding sensor electrodes 4A and 4B and also connected to the inputs of buffers 11 and 12, the outputs of which are applied to the guard ring electrodes 5A and 5B of the electrode assemblies 2 and 3 so as to prevent the dispersion of the electric lines of force 6 across the sensor electrodes 4A and 4B as shown in FIG. 2.

Different details of a coin can be seen by forming the electric lines of force 6 into a beam. A start point where the measurement of a detected output at the position of the sensor electrodes is initially done is set.

The outputs of the buffers 11 and 12 are connected to detecting and recticfyng circuits 13 and 14, respectively, where the signal components centered at the frequency f0 are changed into DC voltages, which are then added in an adder 15. The output of the adder 15 is then input to a thickness detector 16 and a pattern detector 17.

The thickness detector 16 determines whether the thickness of the coin is appropriate by detecting whether a fluctuation of the voltage output from the adder 15 generated when the coin passes between the electrode assemblies is in a range corresponding to an appropriate thickness condition. The pattern detector 17 detects the presence of a pattern depending on whether the fluctuation of the output voltage signal from the adder 15 is in a waveform range corresponding to the pattern of the coin. The results of the detections are delivered to a controller 18 where the validation and kind of the coin are determined.

Figure 3:
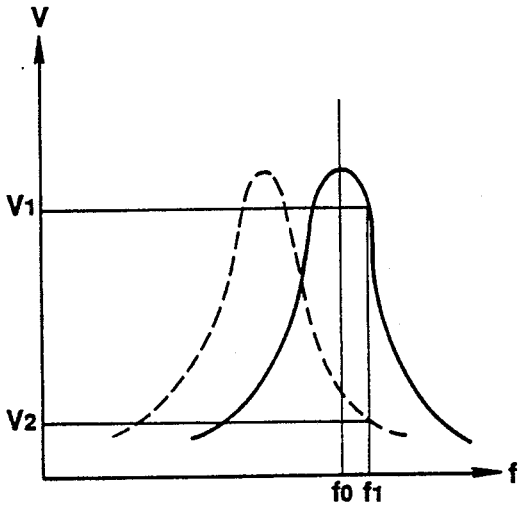
FIG. 3 is a waveform for illustrating a change in the resonating output waveform.

The operation of the arrangement performed when the coin 1 passes through the electrode assemblies 2 and 3 will be described. In a standby state, a voltage V1 is generated at a frequency f1 across each of the capacitors C1 and C2 as shown in FIG. 3. The frequency f0 is the resonant frequency in the standby state. Under such condition, when the coin is deposited to pass between the electrode assemblies 2 and 3, the capacitance between the electrode assemblies 2 and 3 changes during passage of the coin 1, so that the curve on the resonating waveform shown in FIG. 3 moves from the position shown by the solid line to the position shown by the broken lines on a lower frequency side. At the frequency f1, the voltage across the capacitors C1 and C2 decreases from V1 to V2. In this case, a change in the capacitance during passage of the coin is small, for example, 0.1 pF or less, but that small change can be extracted as a large change in the voltage amplitude because the resonating frequency deviates. Changes in the voltages across the capacitors C1 and C2 are detected and rectified by the detecting and rectifying circuits 13 and 14 via the buffers 11 and 12 into the waveforms a (solid line) and b (broken line) shown in FIG. 4. A shown in FIG. 5, the thickness (t) of the coin is represented by $t=D-(D1+D2)$ where D is the distance between the electrode assemblies 2 and 3, D1 is the distance between the electrode assembly 2 and the front of the coin 1, and D2 is the distance between the electrode assembly 3 and the back of the coin 1. The waveform c (dot-dashed line) comprising the addition of the waveforms a (solid line) and b (broken line) in FIG. 4 has a correlation to the thickness of the coin (microscopically, the pattern on each of the faces of the coin) as obtained from the above equation. Namely, if the waveform c is used, the thickness of the coin 1 having passed between the electrode assemblies 2 and 3 can be detected even if the coin 1 passes closer to the electrode assembly 2 than to the electrode assembly 3 and vice verse.

Figure 4:
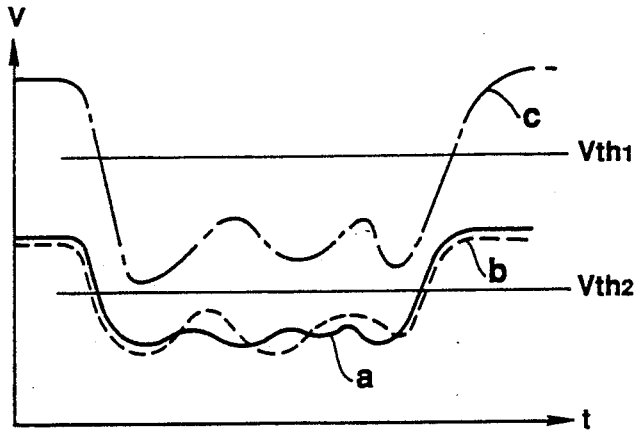
FIG. 4 is a waveform illustrating the detection of the thickness of a coin.
Figure 6:
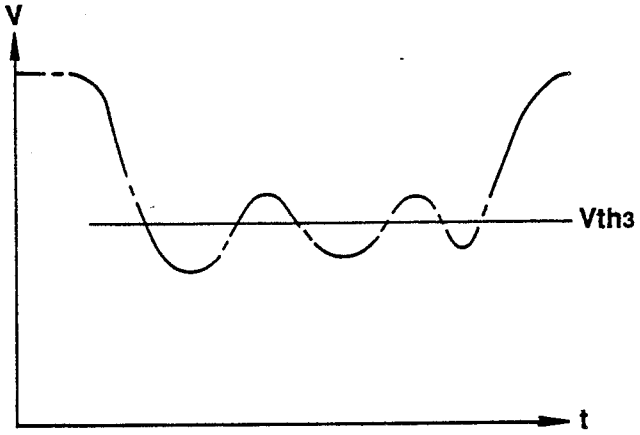
FIGS. 6 and 7 each are a waveform explaining the detection of a coin pattern.
Figure 7:
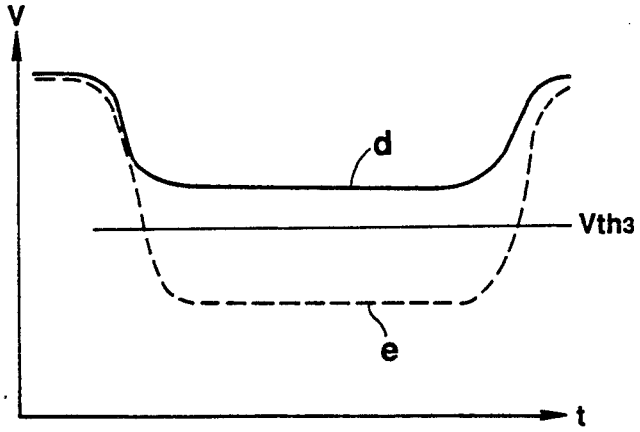
Figure 5:
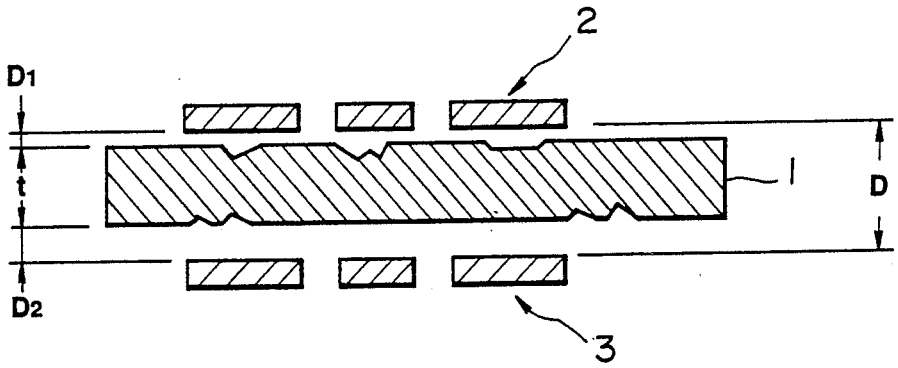
FIG. 5 illustrates the relationship between the thickness and capacitance of a coin.

The details of the thickness detector 16 are not shown. As shown in FIG. 4, a comparator or the like is used to detect whether the bottom of the waveform c is between set reference voltages Vth1 and Vth2. While the details of the pattern detector 17 are not shown, a reference voltage Vth3 is set as shown in FIG. 6 and the determination "there is a pattern" is done if the bottom of the waveform c crosses Vth3 three times or more. With a false coin without patterns, the output waveform c of the adder 15 is shown by d (solid line) or e (broken line) in FIG. 7 and does not cross Vth3 three times or more. Therefore, it is determined that the coin has no patterns.

Figure 8:
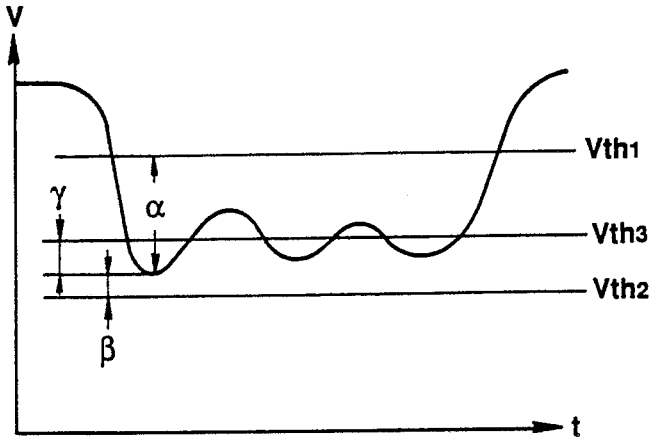
FIG. 8 is a waveform illustrating a process for setting variable reference voltage to detect the thickness and pattern of a coin.

While the above embodiment uses the fixed levels Vth1, Vth2, Vth3, they may be set variably as follows. As shown in FIG. 8, Vth1, Vth2 and Vth3 are set at levels shifted by particular respective voltages ($\alpha$, $\beta$, $\gamma$) with reference to the minimum fall voltage level of the output waveform c from the adder 15. By such setting, the thickness and/or pattern of the coin can be detected surely even if the ambient conditions change due to humidity and/or deposition of dust.

Figure 9:
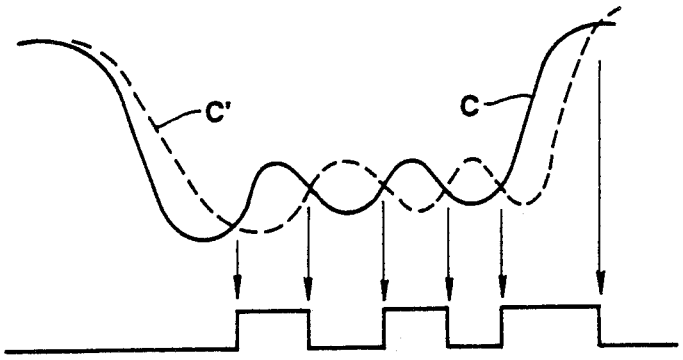
FIG. 9 is a waveform illustrating another process for detecting a pattern.

Alternatively, by comparison between the output waveform c of the adder 15 and a delayed version c' of the waveform c, a pulse waveform corresponding to the ruggedness of the pattern is extracted, and the presence of the pattern can be detected using the number and width of pulses in the pulse waveform without using Vth3, as shown in FIG. 9.

Figure 10:
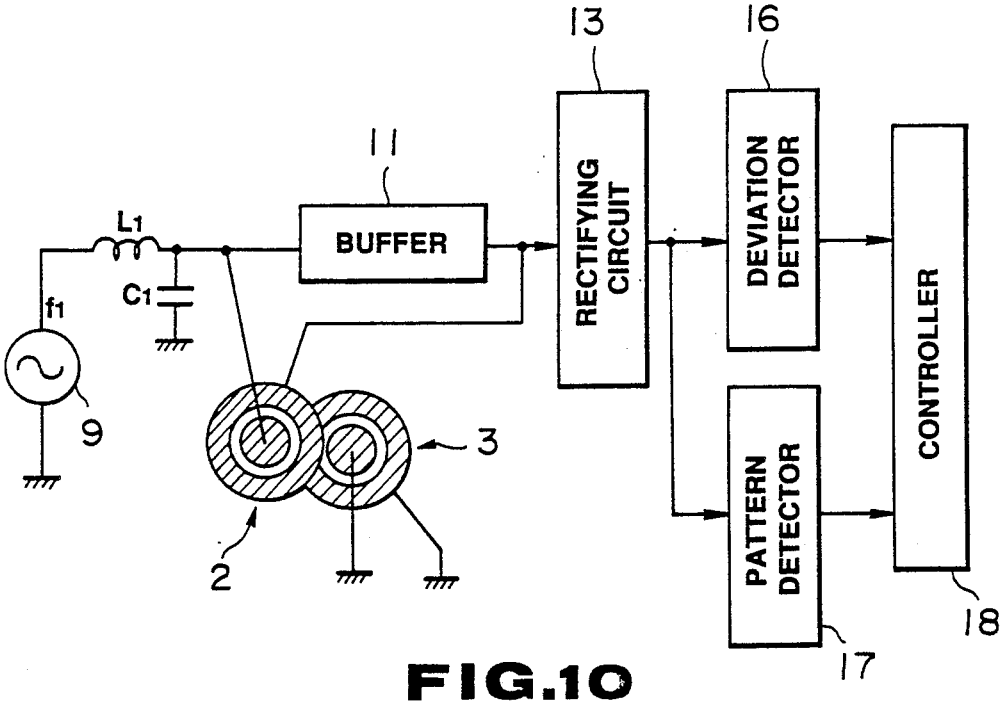
FIG. 10 is a circuit diagram of another embodiment of the present invention.
Figure 11:
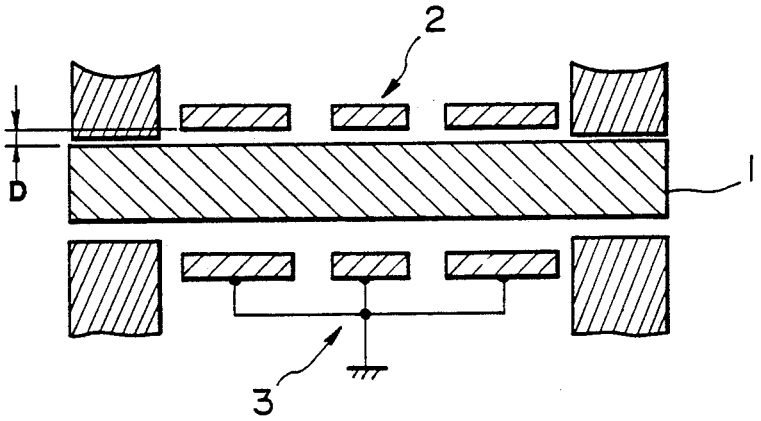
FIG. 11 illustrates the positional relationship between an electrode and a coin in FIG. 10.

Unlike the above embodiment, the thickness and pattern of a coin can be detected by grounding the electrode assembly 3 at OV by using a change in the output voltage from the capacitor C1 due to a change in the capacitance between the coin 1 and the electrode assembly 2 as shown in FIG. 10. In this case, the thickness detector 16 is required to function as a displacement detector 16 and the pattern detector 17 is required to function as a circuit to detect a pattern on one of the coin faces. It is necessary to set the relative relationship between the coin 1 and the electrode assembly 2 such that they have a constant distance D therebetween as shown in FIG. 11. This can be easily realized by inclining the coin path toward the electrode assembly 2 or 3.

While in the above embodiment both the thickness and pattern of the coin have been described so as to be detected, arrangement may be such that only one of the thickness and pattern of the coin can be detected.

What is claimed is:

1. A coin validator comprising:

a first sensor electrode disposed on one side of a coin path;

a first guard ring electrode surrounding the first sensor electrode for preventing the dispersion of electric lines of force generated by the first sensor electrode;

a second sensor electrode disposed on the other side of the coin path so as to oppose the first sensor electrode;

a second guard ring electrode surrounding the second sensor electrode for preventing the dispersion of electric lines of force generated by the second sensor electrode;

an oscillator for outputting an oscillating signal of a predetermined frequency;

a resonator resonating with the oscillating signal from the oscillator for applying a resonating output therefrom to the first and the second sensor electrodes; and means for detecting the nature of a coin in accordance with the output voltage signal from the resonator during the passage of the coin through the coin path.

2. A coin validator according to claim 1, wherein the resonator comprises:

a first and a second resonating circuits for applying resonating outputs of opposite polarities to the first and the second sensor electrodes, respectively; and the detecting means comprises:

a first and a second detecting and rectifying circuits for detecting and rectifying output signals from the first and the second resonating circuits, respectively;

an adder for adding the output signals from the first and second detecting and rectifying circuits; and a circuit for detecting the nature of the coin by comparing an output signal from the adder and a predetermined reference voltage.

3. A coin validator according to claim 2, wherein the detecting circuit changes and sets the reference voltage in accordance with a minimum output fall voltage from the adder.

4. A coin validator according to claim 2, wherein the detecting circuit compares the output signal voltages from the resonator with a first and a second reference voltages to determine that the coin is within a predetermined thickness condition when the output signal voltage from the resonator is between the first and the second reference voltages.

5. A coin validator according to claim 2, wherein the detecting circuit determines that the coin has a pattern when the output signal voltage from the resonator crosses the predetermined reference voltage by predetermined times.

6. A coin validator according to claim 2, wherein the detecting circuit comprises:

means for extracting a pulse waveform corresponding to a ruggedness of a pattern of the coin by comparing the output waveform of the adder and a delayed version of this output waveform; and means for detecting the presence of the pattern of the coin in accordance with the number and width of pulses in this pulse waveform.

7. A coin validator according to claim 1, wherein one of the first and the second sensor electrodes is impressed with the output of the resonator and the other one of the first and the second sensor electrodes is grounded.

8. A coin validator according to claim 1, wherein the first and the second guard ring electrodes are impressed with signals changing depending on changes in the signals applied to the first and second sensor electrodes, respectively.

9. A coin validator comprising:

a first sensor electrode disposed on one side of a coin path;

a first guard ring electrode surrounding the first sensor electrode for preventing the dispersion of electric lines of force generated by the first sensor electrode;

a second sensor electrode disposed on the other side of the coin path so as to oppose the first sensor electrode;

a second guard ring electrode surrounding the second sensor electrode for preventing the dispersion of electric lines of force generated by the second sensor electrode;

an oscillator for outputting an oscillating signal of a predetermined frequency;

a resonator resonating with the oscillating signal from the oscillator for applying a resonating output therefrom to the first and the second sensor electrodes;

means for detecting a thickness of a coin in accordance with an output voltage signal from the resonator during the passage of the coin through the coin path; and means for detecting a pattern of the coin in accordance with the output signal voltage from the resonator during the passage of the coin.

10. A coin validator according to claim 9, wherein the resonator comprises:

a first and a second resonating circuits for applying resonating outputs of opposite polarities to the first and the second sensor electrodes, respectively; and the thickness detecting means comprises:

a first and a second detecting and rectifying circuits for detecting and rectifying output signals from the first and the second resonating circuits, respectively;

an adder for adding the output signals from the first and the second detecting and rectifying circuits; and means for comparing an output signal from the adder with a first and a second reference voltages to determine that the thickness of the coin is within a determined thickness range when the output signal voltage from the resonator is between the first and the second reference voltages; and the pattern detecting means comprises:

a circuit for detecting the pattern of the coin by comparing the output signal from the adder with a third reference voltage.

11. A coin validator according to claim 10, wherein the first, the second and the third reference voltages are changed and set in accordance with a minimum fall voltage from the adder.

12. A coin validator according to claim 10, wherein the pattern detecting means determines that the coin has a pattern when the output signal voltage from the resonator crosses the predetermined reference waveform by at least predetermined times.

13. A coin validator according to claim 10, wherein the pattern detecting means comprises:

means for extracting a pulse waveform corresponding to a ruggedness of a pattern of the coin by comparing the output waveform of the adder and a delayed version of this output waveform; and means for detecting the presence of the pattern of the coin in accordance with the number and width of pulses in this pulse waveform.

14. A coin validator according to claim 9, wherein one of the first and the second sensor electrodes is impressed with the output of the resonator and the other one of the first and the second sensor electrodes is grounded.

15. A coin validator according to claim 9, wherein the first and the second guard ring electrodes are impressed with signals changing depending on changes in the signals applied to the first and the second sensor electrodes, respectively.

* * * * *